US006620765B2

(12) United States Patent
Idehara et al.

(10) Patent No.: US 6,620,765 B2
(45) Date of Patent: Sep. 16, 2003

(54) THERMAL TRANSFER IMAGE-RECEIVING SHEET

(75) Inventors: Tomoyuki Idehara, Tokyo-To (JP); Kenji Sakamoto, Tokyo-To (JP); Kyoko Nishigaya, Tokyo-To (JP); Kazushi Kimura, Tokyo-To (JP); Hitoshi Saito, Tokyo-To (JP); Ayako Mishina, Tokyo-To (JP)

(73) Assignee: Dai Nippon Printing Co., Inc. (JP)

( * ) Notice: Subject to any disclaimer, the term of this patent is extended or adjusted under 35 U.S.C. 154(b) by 16 days.

(21) Appl. No.: 09/820,308

(22) Filed: Mar. 29, 2001

(65) Prior Publication Data

US 2002/0058129 A1 May 16, 2002

(30) Foreign Application Priority Data

| | | |
|---|---|---|
| Apr. 6, 2000 | (JP) | 2000-105425 |
| Mar. 21, 2001 | (JP) | 2001-080819 |
| Mar. 7, 2001 | (JP) | 2001-063505 |

(51) Int. Cl.[7] ..... B41M 5/035; B41M 5/38

(52) U.S. Cl. ..... 503/227

(58) Field of Search ..... 8/471; 428/195; 503/227

(56) References Cited

U.S. PATENT DOCUMENTS

| | | | |
|---|---|---|---|
| 5,928,990 A | 7/1999 | Guistina et al. | 503/227 |
| 5,932,355 A | 8/1999 | Iqbal et al. | 428/447 |

FOREIGN PATENT DOCUMENTS

| | | |
|---|---|---|
| WO | WO 97/15456 | 5/1997 |

*Primary Examiner*—B. Hamilton Hess
(74) *Attorney, Agent, or Firm*—Parkhurst & Wendel, L.L.P.

(57) ABSTRACT

A thermal transfer image-receiving sheet is provided which, when a protective layer is formed by thermal transfer on an image formed of a chelated dye, can provide excellent adhesion of the protective layer onto the image and can realize good image quality. The thermal transfer image-receiving sheet comprises: a substrate sheet; and a receptive layer provided on the substrate sheet, the receptive layer comprising a metal source, a protective layer bonding/holding agent, and a binder resin.

10 Claims, No Drawings

THERMAL TRANSFER IMAGE-RECEIVING SHEET

TECHNICAL FIELD

The present invention relates to a thermal transfer image-receiving sheet comprising a receptive layer provided on a substrate sheet, and more particularly to a thermal transfer image-receiving sheet of a type such that a metal source (a metal ion-containing compound) is contained in the receptive layer and, upon the transfer of a dye, which can be chelated, from a thermal transfer sheet onto the receptive layer, the dye is chelated and is fixed onto the receptive layer, which thermal transfer image-receiving sheet, when a protective layer is transferred on the receptive layer with the image formed thereon, the receptive layer has excellent adhesion to the protective layer.

BACKGROUND OF THE INVENTION

In the formation of an image in response to image information by means of thermal printing means, such as a thermal head or a laser, a method has been proposed wherein a thermal transfer sheet provided with a sublimable dye layer, which is transferable upon heating, is used in combination with a thermal transfer image-receiving sheet and the dye is transferred onto the thermal transfer image-receiving sheet while controlling the sublimable dye to form a gradational photograph-like image. This method is advantageous, for example, in that images with continuous gradation can be provided by simple processing from digital image data on a digital camera or a personal computer or image data through a network and television signals and, in this case, the apparatus used is not complicate.

In this type of thermal transfer recording, the sublimable dye used in the thermal transfer sheet plays an important role. Conventional sublimable dyes, however, have a drawback that the formed images have unsatisfactory fastness properties, that is, unsatisfactory lightfastness and fixation. In order to reduce this problem, Japanese Patent Laid-Open Nos. 78893/1984, 109394/1984, and 2398/1985 disclose an image forming method wherein a heat diffusive colorant (dye), which can be chelated, is used to form an image of a chelated colorant (a chelate dye) on a thermal transfer image-receiving sheet.

The method for forming an image of a chelated dye is effective for improving the heat resistance and lightfastness of images and the dye fixation. In this method, however, after printing, the dye remaining unreacted is present around the surface of the receptive layer, and thus results in unsatisfactory fastness properties of transferred images. Specifically, when the formed image comes into contact with a finger or when the formed image is continuously in contact with a plasticizer-containing sheet, for example, dropouts occur, making it difficult to maintain the image quality. In order to reduce this problem, an attempt has been made to thermally transfer a protective layer onto an image from a protective layer transfer sheet having a thermally transferable protective layer. This, however, has posed a problem that the metal source (metal ion-containing compound) present in the receptive layer inhibits the adhesion between the protective layer and the receptive layer and the protective layer is easily separated from the receptive layer.

DISCLOSURE OF THE INVENTION

Accordingly, it is an object of the present invention to provide a thermal transfer image-receiving sheet which, when a protective layer is formed by thermal transfer on an image formed of a chelated dye, can provide excellent adhesion of the protective layer onto the image and can realize good image quality.

According to one aspect of the present invention, there is provided a thermal transfer image-receiving sheet comprising: a substrate sheet; and a receptive layer provided on the substrate sheet, said receptive layer comprising a metal source, a protective layer bonding/holding agent, and a binder resin.

The protective layer bonding/holding agent is preferably a surfactant having a polyoxyalkylene group. The surfactant is preferably a fluorosurfactant or a polyether-modified silicone.

The fluorosurfactant preferably has a straight-chain polyoxyalkylene group, and the polyether-modified silicone is preferably a silicone modified by providing a polyoxyalkylene group on its side chain.

Preferably, the receptive layer contains a release agent.

According to a preferred embodiment of the present invention, the content of the protective layer bonding/holding agent is in the range of 0.25 to 7.5% by mass based on the solid content of the whole receptive layer. More preferably, the protective layer bonding/holding agent comprises a component having an HLB value of not less than 5.0.

Thus, in a thermal transfer image-receiving sheet comprising a receptive layer provided on a substrate sheet, the incorporation of a metal source in combination with a protective layer bonding/holding agent and a binder resin into the receptive layer enables a deterioration in adhesion between the metal source-containing receptive layer and the transferred protective layer to be prevented by the protective layer bonding/holding agent, and thus can realize a thermal transfer image-receiving sheet which can provide images of a chelated dye possessing excellent quality.

BEST MODE FOR CARRYING OUT THE INVENTION

Preferred embodiments of the present invention will be described in detail.

The thermal transfer image-receiving sheet according to the present invention comprises a substrate sheet and a receptive layer provided on the substrate sheet.

(Substrate Sheet)

The substrate sheet functions to hold the receptive layer, and is heated at the time of thermal transfer. Therefore, the substrate sheet preferably has mechanical strength on a level such that, even in a heated state, the substrate sheet can be handled without any trouble. Materials for such substrate sheets are not particularly limited, and examples of substrate sheets usable herein include: various types of paper, for example, capacitor paper, glassine paper, parchment paper, or paper having a high sizing degree, synthetic paper (such as polyolefin synthetic paper and polystyrene synthetic paper), cellulose fiber paper, such as wood free paper, art paper, coated paper, cast coated paper, wall paper, backing paper, synthetic resin- or emulsion-impregnated paper, synthetic rubber latex-impregnated paper, paper with synthetic resin internally added thereto, and paperboard; and films of polyester, polyacrylate, polycarbonate, polyurethane, polyimide, polyether imide, cellulose derivative, polyethylene, ethylene-vinyl acetate copolymer, polypropylene, polystyrene, acrylic resin, polyvinyl chloride, polyvinylidene chloride, polyvinyl alcohol, polyvinyl butyral, nylon, polyether ether ketone, polysulfone, polyether sulfone, tetrafluoroethylene-perfluoroalkyl vinyl ether, polyvinyl fluoride, tetrafluoroethylene-ethylene, tetrafluoroethylene-hexafluoropropylene, polychlorotrifluoroethylene, polyvinylidene fluoride and the like. Further, for example, white opaque films produced by adding a white pigment or a filler to these synthetic resins and forming films from the mixtures, or foamed sheets produced by foaming the resin may also be used without particular limitation.

A laminate of any combination of the above substrate sheets may also be used. Examples of representative laminates include a laminate composed of a cellulose fiber paper and a synthetic paper and a laminate composed of a cellulose fiber paper and a plastic film. The thickness of the substrate sheet may be any desired one, and is generally about 10 to 300 $\mu$m. When the substrate sheet has poor adhesion to the receptive layer formed on its surface, the surface of the substrate sheet is preferably subjected to primer treatment or corona discharge treatment.

(Receptive Layer)

The receptive layer is provided on one side of the substrate sheet, and comprises a metal source, a protective layer bonding/holding agent, a binder resin, and optional additives such as a release agent. The binder resin is preferably easily dyeable with a sublimable dye. Binder resins usable herein include polyolefin resins, such as polypropylene, halogenated resins, such as polyvinyl chloride and polyvinylidene chloride, vinyl resins, such as polyvinyl acetate and polyacrylic esters, polyester resins, such as polyethylene terephthalate and polybutylene terephthalate, polystyrene resins, polyamide resins, resins based on copolymers of olefins, such as ethylene or propylene, with other vinyl monomers, ionomers, and cellulose derivatives. The receptive layer preferably contains a release agent from the viewpoint of preventing the heat fusion to the dye layer to prevent abnormal transfer.

The release agent is preferably a silicone oil because the silicone oil bleeds from the interior of the receptive layer onto the surface of the receptive layer to easily form a release layer on the surface of the receptive layer. Preferred silicone oils include phenyl-modified, carbinol-modified, amino-modified, alkyl-modified, epoxy-modified, carboxyl-modified, alcohol-modified, fluorine-modified, and other modified silicone oils.

Particularly preferred are modified silicone oils represented by the following chemical formula which do not adversely affect the metal source and the protective layer bonding/holding agent, do not adversely affect a chelating reaction of the dye, which can be chelated, from the dye layer with the metal source, and have excellent releasability from the dye layer.

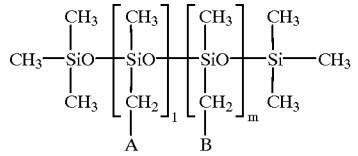

wherein A represents an aryl group, such as a phenyl group; B represents an epoxy-modified alkyl chain; and l and m are an integer of 1 or more.

It is also possible to use a reaction cured product of a plurality of modified silicone oils, such as a product of a reaction of a vinyl-modified silicone oil with a hydrogen-modified silicone oil or a cured product of a reaction of an amino-modified silicone oil with an epoxy-modified silicone oil, and a reaction cured product prepared by reacting an active hydrogen-containing modified silicone oil with a curing agent reactive with active hydrogen.

The amount of the release agent added is preferably 0.5 to 10% by mass based on the solid content of the receptive layer.

In the thermal transfer image-receiving sheet according to the present invention, the metal source is preferably added in an amount of not more than 50% by mass, particularly preferably not more than 40% by mass, based on the binder resin in the receptive layer, for example, because, when the metal source is mixed with the protective layer bonding/holding agent, excellent adhesion can be provided between the receptive layer and the protective layer.

According to the present invention, preferred metal sources are compounds represented by formula (I):

$$M^{2+}(X)_n 2Y^- \quad (1)$$

wherein $M^{2+}$ represents a divalent transition metal ion; X represents a coordination compound which can be coordinately bonded to the transition metal ion $M^{2+}$ to form a complex; n is an integer of 2 or 3; and $Y^-$ represents a counter ion of the transition metal ion $M^{2+}$, provided that a plurality of coordination compounds Xs may be the same or different.

In the compounds represented by formula (1), $M^{2+}$ represents a divalent transition metal ion, and examples of transition metal ions include cobalt($^{2+}$), nickel($^{2+}$), copper ($^{2+}$), zinc($^{2+}$), and iron($^{2+}$). Among them, nickel($^{2+}$), copper ($^{2+}$), and zinc($^{2+}$) are particularly preferred. In the compounds represented by formula (1), $(X)_n$ represents two or three coordination compounds which can coordinately bond to transition metals to form complexes. The coordination compound can be selected from coordination compounds described, for example, in "Kireto Kagaku (Chelate Chemistry) (5)" (edited by Nan'un-do Co., Ltd.). Among them, ethylenediamine derivatives, picolinamide derivatives, 2-aminomethylpiperidine derivatives, and glycinamide derivatives are preferred. Particularly preferred are ethylenediamine derivatives and glycinamide derivatives.

In the compound represented by formula (1), $Y^-$ represents a counter anion of the transition metal ion $M^{2+}$. This counter anion is an organic or inorganic anion, and, in particular, is preferably a compound which can render the complex of the transition metal ion $M^{2+}$ with the coordination compound $(X)_n$ dissolvable in an organic solvent, for example, methyl ethyl ketone or tetrahydrofuran (THF). Specific examples of counter anions include organic salts of alkylcarboxylic acids, arylcarboxylic acids, alkylsulfonic acids, arylsulfonic acids, alkylphosphoric acids, arylphosphoric acids, and arylboric acids. Among them, for example, organic salts of arylboric acids and arylsulfonic acids are particularly preferred.

The receptive layer according to the present invention preferably contains a metal source represented by formula (2):

$$M^{2+}(X^-)_2 \quad (2)$$

wherein $M^{2+}$ represents a divalent transition metal ion; and $X^-$ represents a coordination compound represented by formula (1). The compound represented by formula (2) may have a neutral ligand according to a central metal, and representative ligands include $H_2O$ and $NH_3$.

Metal sources represented by formula (2) include those wherein X represents a coordination compound represented by formula (3):

(3)

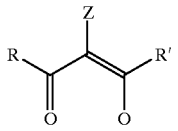

In the compound represented by formula (3), Z represents an alkyl, aryl, alkoxy, acyl, alkoxycarbonyl, aryloxycarbonyl, or carbamoyl group or a halogen or hydrogen atom. Preferred Zs are electron-withdrawing groups, such as aryloxycarbonyl groups, alkoxycarbonyl groups, and halogen atoms, because they can stabilize metal ion donating compounds. Among them, aryloxycarbonyl groups and alkoxycarbonyl groups are further preferred from the viewpoint of solubility. Aryloxycarbonyl groups include a phenoxycarbonyl group, and alkoxycarbonyl groups include straight-chain or branched alkoxycarbonyl groups having 1 to 20 carbon atoms, such as methoxycarbonyl, ethoxycarbonyl, pentyloxycarbonyl, and 2-ethylhexyloxycarbonyl groups. These alkoxycarbonyl groups may be substituted, for example, by a halogen atom, an aryl group, or an alkoxy group.

R and R', which may be the same or different, each represent an alkyl or aryl group. R and Z or R' and Z may combine with each other to form a ring, provided that when Z represents a hydrogen atom, both R and R' do not simultaneously represent a methyl group. Alkyl groups represented by Z, R, and R' include, for example, straight-chain or branched alkyl groups having 1 to 20 carbon atoms, such as methyl, ethyl, propyl, isopropyl, butyl, sec-butyl, t-butyl, hexyl, octyl, and 2-ethylhexyl groups. These alkyl groups may be substituted, for example, by a halogen atom, an aryl group, or an alkoxy group. Aryl groups represented by Z, R, and R' include substituted or unsubstituted phenyl and naphthyl groups. Alkoxy groups represented by Z include straight-chain or branched alkoxy groups having 1 to 20 carbon atoms, such as methoxy, ethoxy, and butoxy groups. Acyl groups represented by Z include acetyl, propionyl, chloroacetyl, phenacetyl, and benzoyl groups. The halogen atom represented by Z is preferably a chlorine atom.

The amount of the metal source used in the present invention is preferably 20 to 50% by mass, more preferably 30 to 40% by mass, based on the binder resin for a receptive layer. The metal source according to the present invention is not limited to the compounds represented by formulae (1) and (2).

The protective layer bonding/holding agent used in the thermal transfer image-receiving sheet according to the present invention is preferably a fluorosurfactant, and examples thereof include perfluoroalkylsulfonamide esters of polyethylene oxide (FC-430, FC-431, and FC-170, manufactured by Sumitomo 3M Ltd.; and EF-122A, EF-122B, EF-122C, EF-122A3, and EF-501, manufactured by Mitsubishi Materials Corporation.).

Additional examples of the protective layer bonding/holding agent include perfluoroalkyl ethylene oxide adducts (F-142D, F-144D, and F-1405, manufactured by Dainippon Ink and Chemicals, Inc.; KH-40, manufactured by SEIMI CHEMICAL CO., LTD.; and DS-401 and DS-403, manufactured by Daikin Industries, Ltd.).

Further examples of the protective layer bonding/holding agent include hydrocarbon acrylate-perfluorocarbon acrylate copolymers (EF-351, EF-352, EF-801, EF-802, and EF-6011, manufactured by Mitsubishi Materials Corporation.).

Still further examples of the protective layer bonding/holding agent include fluoroalkyl polyoxyethylene ethers (FTX-251 and FTX-22, manufactured by Neos Co., Ltd.).

Preferred polyether-modified silicones include those which have been modified by providing a polyoxyalkylene group on its side chain and have an HLB value (hydrophile-lipophile balance), which is an aspect representing the properties of surfactants, of not less than 5.0.

$$HLB = \frac{\text{Molecular weight of hydrophilic group}}{\text{Molecular weight of surfactant}} \times \frac{100}{5}$$

Reference: Awa No Hassei Mekanizumu To Seigyo Oyobi Toraburu Taisaku (Mechanism and control of foam formation and measures against troubles), published by Gijutu Joho Kyokai.

The protective layer bonding/holding agent is preferably added in an amount of 0.25 to 7.5% by mass based on the solid content of the whole receptive layer. It is considered that, while the metal ion-containing compound and the release agent present in the receptive layer inhibit the adhesion of the receptive layer to the protective layer, the protective layer bonding/holding agent covers the metal ion-containing compound and the release agent on the surface of the receptive layer and, in addition, can improve the wettability to enhance the adhesion between the receptive layer and the transferred protective layer. When the content of the protective layer bonding/holding agent is less than 0.25% by mass based on the solid content of the whole receptive layer, the adhesion between the receptive layer and the transferred protective layer is disadvantageously deteriorated. On the other hand, when the content of the protective layer bonding/holding agent exceeds 7.5% by mass based on the solid content of the whole receptive layer, the wettability of the surface of the receptive layer is so high that the relesability between the receptive layer and the dye layer is disadvantageously deteriorated.

The receptive layer may be formed by coating an ink, prepared by adding a metal source, a protective layer bonding/holding agent, and optional additives, such as a release agent, to a binder resin, dissolving or dispersing the mixture in water or a solvent such as an organic solvent, onto a substrate sheet by a conventional method, such as bar coating, gravure printing, screen printing, or reverse roll coating using a gravure plate and drying the coating. Instead of this method wherein an ink is coated directly onto a substrate sheet to form a coating which is then dried, a method may be adopted wherein a receptive layer may be transferred onto a substrate sheet from a receptive layer transfer sheet comprising a receptive layer provided on a different substrate sheet. This different substrate sheet may be formed of the same material as used in the substrate sheet. The thickness of the receptive layer is preferably about 0.1 to 10 $\mu$m on a dry basis, i.e., after coating and drying.

The thermal transfer sheet used in the formation of an image on the thermal transfer image-receiving sheet comprises a substrate and, provided on the substrate, a dye layer composed mainly of a thermally transferable dye, which can be chelated, and a binder resin. The thermally transferable dye is not particularly limited, and conventional thermally transferable dyes may be used so far as the dye has a group which can combine with the above-described metal source to form a complex.

The protective layer transfer sheet for use in the formation of a protective layer by thermal transfer onto the image forming face (receptive layer face) in the thermal transfer image-receiving sheet according to the present invention will be described.

(Substrate Sheet)

The same substrate sheet as used in the conventional thermal transfer sheet as such may be used as the substrate sheet used in the protective layer transfer sheet according to the present invention. Further, a film, the surface of which has been subjected to easy-adhesion treatment, and other substrates may also be used without particular limitation. The thickness of the substrate sheet may properly vary depending upon the material constituting the substrate so that the strength and heat resistance of the substrate sheet are proper. In general, the thickness is preferably about 3 to 100 $\mu$m.

(Release Layer)

In general, a thermally transferable resin layer is provided on one side of the substrate sheet to prepare a protective layer transfer sheet. In some cases, for some combination of the material constituting the substrate sheet with the material constituting the thermally transferable resin layer, the releasability is not good at the time of the thermal transfer. In this case, a release layer may be previously provided on the surface of the substrate sheet.

The release layer may be formed by coating a coating liquid containing at least one of a wax, a silicone wax, a silicone resin, a fluororesin, an acrylic resin, polyvinyl alcohol, a cellulose derivative resin, a urethane resin, an alkyl vinyl ether/maleic anhydride copolymer resin and the like by a conventional method such as gravure coating or gravure reverse coating and drying the coating. A coating thickness of about 0.1 to 2 $\mu$m suffices for the release layer. What is important for selecting the material used in the release layer is, of course, that the material has proper releasability from the thermally transferable resin layer. Further, it is important that the adhesion of the material to the substrate sheet be higher than the adhesion of the material to the thermally transferable resin layer. Unsatisfactory adhesion of the material to the substrate sheet is causative of abnormal transfer, for example, such that the release layer, together with the transferable resin layer, is transferred.

When a matte protective layer is desired on an as-transferred print, a method may be used wherein various particles are incorporated into the release layer, or wherein a substrate sheet in its surface, on the release layer side, which has been matted, may be used to render the surface of a print, with the protective layer transferred thereon, matte.

(Thermally Transferable Resin Layer)

In the protective layer transfer sheet, the thermally transferable resin layer is thermally transferred onto an object in its print face to form a protective layer. Therefore, functions, which the thermally transferable resin layer should have, include sure, i.e., good, separation and transfer from the substrate sheet or the release layer provided on the substrate sheet at the time of the thermal transfer, thermal adhesion to an object, a capability of imparting, as a protective layer for the print face, various resistance properties, such as abrasion resistance and scratch resistance, and transparency high enough not to deteriorate the sharpness of the transferred image underlying the protective layer. Therefore, the thermally transferable resin layer may have a single-layer structure. Alternatively, a thermally transferable resin layer having a two-layer, three-layer, or other multi-layer construction, for example, comprising a transparent resin layer and thermally adhesive resin layer provided in that order from the substrate sheet side, or a transparent resin layer, an ultraviolet cut-off layer, and a thermally adhesive resin layer provided in that order from the substrate sheet side is also preferred. Each layer used in this case will be described.

(Transparent Resin Layer)

The transferable resin layer provided on the substrate sheet or the release layer, that is, the layer, of the thermally transferable resin layer, on the substrate sheet side, may be formed of, for example, a resin possessing, for example, excellent abrasion resistance, transparency, and hardness, for example, polyester resin, polystyrene resin, acrylic resin, polyurethane resin, acrylated urethane resin, a silicone modification product of these resins, a mixture of these resins, or a resin prepared by crosslinking and curing at least one of a polymerizable monomer, an oligomer, a reactive polymer described below by exposure to an ionizing radiation such as an electron beam. The cured resin layer may contain, as a mixture thereof, a highly compatible thermoplastic resin from the viewpoint of improving flexibility and adhesion.

Although these resins have excellent transparency, they are likely to form a relatively strong film which has unsatisfactory tranferability at the time of thermal transfer. In order to improve, for example, the transferability of the transparent resin layer, abrasion resistance and scratch resistance of the print face on which the resin is covered by transfer, for example, highly transparent fine particles, such as silica, alumina, calcium carbonate, plastic pigments, or waxes may be added in such an amount that does not sacrifice the transparency of the resin. The particle diameter of the fine particles is preferably about 0.1 to 10 $\mu$m. Further, silicone-modified resins, lubricants or other additives may be added to further improve the abrasion resistance and the scratch resistance.

Gravure coating, gravure reverse coating, roll coating, and other various means may be utilized for the formation of the transparent resin layer. The transparent resin layer may be formed by coating a coating liquid containing the above resin by the above means and drying the coating. The thickness of the transparent resin layer is about 0.1 to 50 $\mu$m, preferably about 1 to 10 $\mu$m, on a dry basis.

(Ultraviolet Cut-Off Layer)

An ultraviolet cut-off layer formed of a thermally transferable resin with an ultraviolet absorber added thereto is preferably provided from the viewpoint of preventing images formed on a print, onto which the protective layer is to be transferred, from fading or discoloring upon exposure to ultraviolet light contained, for example, in sunlight. Ultraviolet absorbers usable herein include conventional organic ultraviolet absorbers, such as benzophenone compounds, benzotriazole compounds, oxalic anilide compounds, cyanoacrylate compounds, and salicylate compounds. Further, inorganic fine particles having ultraviolet absorbing activity, such as oxides of zinc, titanium, cerium, tin, and iron may be incorporated into the resin layer. The resin used is not particularly limited, and any resin may be used. Examples of resins usable herein include hydrocarbon resins, such as acrylic resins, polyester resins, urethane resins, styrene resins, halogenated vinyl resins, vinyl acetate resins, polycarbonate resins, phenolic resins, melamine resins, epoxy resins, cellulosic resins, and polyethylene resins, vinyl resins, such as polyvinyl alcohol and polyvinyl pyrrolidine, and copolymers of monomers constituting the above resins. Further, the ultraviolet absorber may be incorporated into the transparent resin layer without specially providing the ultraviolet cut-off layer.

Alternatively, a resin formed by bonding through a reaction a reactive ultraviolet absorber to at least one of a monomer, oligomer, and reactive polymer of a thermoplastic resin is incorporated, solely or as a mixture of two or more types, into any layer constituting the transparent resin layer. The reactive ultraviolet absorber may be fixed through a reaction to the resin by various methods, and an example thereof is to radically polymerize a resin component of a conventional monomer, oligomer, or reactive polymer and the following reactive ultraviolet absorber having an addition polymerizable double bond to prepare a copolymer.

(Thermally Adhesive Resin Layer)

The thermally adhesive resin layer functions to facilitate the transfer of the thermally transferable resin layer onto an object and, at the same time, to enhance the adhesion of the thermally transferred resin layer to the object. This thermally adhesive resin layer may be formed of a heat-melt adhesive, such as acrylic resin, styrene-acryl copolymer, vinyl chloride resin, vinyl chloride-vinyl acetate copolymer, polyester resin, or polyamide resin. The thermally adhesive resin layer may be formed by a conventional method such as gravure coating, gravure reverse coating, or roll coating. The thickness of this layer is preferably about 0.1 to 5 $\mu$m on a dry basis.

Thermal transfer recording is performed, on the above-described thermal transfer image-receiving sheet, using a thermal transfer sheet comprising a substrate and, provided on the substrate, a dye layer, composed mainly of a thermally transferable dye, which can be chelated, and a binder resin. In this case, thermal energy in response to image information is applied by conventional thermal energy application means, such as a thermal head, a laser beam, an infrared flash lamp, or a hot pen.

Further, after thermal transfer recording on the thermal transfer image-receiving sheet according to the present invention to form an image, a protective layer (a thermally transferable resin layer) is thermally transferred from a protective layer transfer sheet onto the image to prepare a print with a protective layer formed thereon. In this case, heating means for the transfer of the protective layer is not limited to a thermal head, and other means, such as hot plates, hot stampers, hot rolls, line heaters, or irons, may be used. The protective layer may be transferred onto the whole area of the receptive layer face including the formed image, or alternatively may be transferred onto a specific portion of the receptive layer face.

EXAMPLES

The following examples further illustrate the present invention. In the following examples, "parts" or "%" is by mass unless otherwise specified.

[Preparation of Coating Liquids For Receptive Layer]

The following coating liquids for a receptive layer (R1 to R26) were prepared.

Coating liquids for receptive layer:

Coating liquids for a receptive layer were prepared using a vinyl chloride-vinyl acetate copolymer (1000A, manufactured by Denki Kagaku Kogyo K.K.) as a binder resin, a metal ion-containing compound represented by the following chemical formula as a metal source, a material shown in Table 1 as a protective layer bonding/holding agent, and an epoxy-modified silicone oil (X22-3000T, manufactured by The Shin-Etsu Chemical Co., Ltd.) as a release agent, according to formulations shown in Table 1 below.

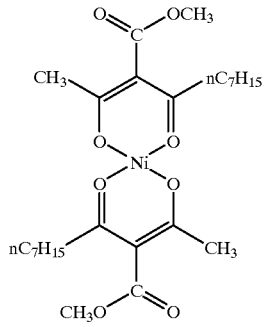

TABLE 1

List of coating liquids for receptive layers used in examples

| Coating liquid for receptive layer | Binder resin | Metal source | Protective layer bonding/holding agent | Release agent |
|---|---|---|---|---|
| R1 | 70 | 30 | FC-431 = 0.25 | 0.00 |
| R2 | 70 | 30 | FC-431 = 0.50 | 0.00 |
| R3 | 70 | 30 | FC-431 = 2.50 | 0.00 |
| R4 | 70 | 30 | FC-431 = 5.00 | 0.00 |
| R5 | 70 | 30 | FC-431 = 0.25 | 5.00 |
| R6 | 70 | 30 | FC-431 = 0.50 | 3.00 |
| R7 | 70 | 30 | FC-431 = 2.50 | 1.50 |
| R8 | 70 | 30 | FTX-22 = 2.50 | 0.00 |
| R9 | 70 | 30 | FTX-22 = 5.00 | 0.00 |
| R10 | 70 | 30 | FTX-22 = 2.50 | 1.50 |
| R11 | 70 | 30 | FTX-22 = 5.00 | 1.50 |
| R12 | 70 | 30 | EF-801 = 2.50 | 1.50 |
| R13 | 70 | 30 | KF352A = 2.50 | 1.50 |
| R14 | 70 | 30 | KF352A = 5.00 | 1.50 |
| R15 | 70 | 30 | KF352A = 7.50 | 1.50 |
| R16 | 70 | 30 | KF352A = 5.00 | 0.00 |
| R17 | 70 | 30 | KF352A = 5.00 | 2.00 |
| R18 | 70 | 30 | FZ2101 = 2.50 | 0.00 |
| R19 | 70 | 30 | FZ2101 = 5.00 | 0.00 |
| R20 | 70 | 30 | FZ2101 = 7.50 | 0.00 |
| R21 | 70 | 30 | FZ2101 = 2.50 | 1.50 |
| R22 | 70 | 30 | FZ2101 = 5.00 | 1.50 |
| R23 | 70 | 30 | FZ2101 = 7.50 | 1.50 |
| R24 | 60 | 40 | FC-431 = 0.25 | 3.00 |
| R25 | 60 | 40 | FC-431 = 0.50 | 3.00 |
| R26 | 60 | 40 | FC-431 = 2.50 | 1.50 |

Example 1

The coating liquid R1 for a receptive layer indicated in Table 1 was coated by wire bar coating on a 150 $\mu$m-thick synthetic paper having colorimetric data of L=92.26, a=−1.05, and b=0.95 (Yupo-FPG-150, manufactured by Oji-Yuka Synthetic Paper Co., Ltd.) as a substrate sheet to a thickness of 5 $\mu$m on a dry basis to prepare a thermal transfer image-receiving sheet of Example 1. In drying the receptive layer, the coated substrate sheet was predried with a drier, and then dried in an oven at a temperature of 130° C. for one min.

Example 2

The procedure of Example 1 was repeated, except that the coating liquid R2 for a receptive layer was used instead of the coating liquid for a receptive layer in Example 1. Thus, a thermal transfer image-receiving sheet of Example 2 was prepared.

Example 3

The procedure of Example 1 was repeated, except that the coating liquid R3 for a receptive layer was used instead of the coating liquid for a receptive layer in Example 1. Thus, a thermal transfer image-receiving sheet of Example 3 was prepared.

Example 4

The procedure of Example 1 was repeated, except that the coating liquid R4 for a receptive layer was used instead of the coating liquid for a receptive layer in Example 1. Thus, a thermal transfer image-receiving sheet of Example 4 was prepared.

Example 5

The procedure of Example 1 was repeated, except that the coating liquid R5 for a receptive layer was used instead of the coating liquid for a receptive layer in Example 1. Thus, a thermal transfer image-receiving sheet of Example 5 was prepared.

Example 6

The procedure of Example 1 was repeated, except that the coating liquid R6 for a receptive layer was used instead of the coating liquid for a receptive layer in Example 1. Thus, a thermal transfer image-receiving sheet of Example 6 was prepared.

Example 7

The procedure of Example 1 was repeated, except that the coating liquid R7 for a receptive layer was used instead of the coating liquid for a receptive layer in Example 1. Thus, a thermal transfer image-receiving sheet of Example 7 was prepared.

Example 8

The procedure of Example 1 was repeated, except that the coating liquid R8 for a receptive layer was used instead of the coating liquid for a receptive layer in Example 1. Thus, a thermal transfer image-receiving sheet of Example 8 was prepared.

Example 9

The procedure of Example 1 was repeated, except that the coating liquid R9 for a receptive layer was used instead of the coating liquid for a receptive layer in Example 1. Thus, a thermal transfer image-receiving sheet of Example 9 was prepared.

Example 10

The procedure of Example 1 was repeated, except that the coating liquid R10 for a receptive layer was used instead of the coating liquid for a receptive layer in Example 1. Thus, a thermal transfer image-receiving sheet of Example 10 was prepared.

Example 11

The procedure of Example 1 was repeated, except that the coating liquid R11 for a receptive layer was used instead of the coating liquid for a receptive layer in Example 1. Thus, a thermal transfer image-receiving sheet of Example 11 was prepared.

Example 12

The procedure of Example 1 was repeated, except that the coating liquid R12 for a receptive layer was used instead of the coating liquid for a receptive layer in Example 1. Thus, a thermal transfer image-receiving sheet of Example 12 was prepared.

Example 13

The procedure of Example 1 was repeated, except that the coating liquid R13 for a receptive layer was used instead of the coating liquid for a receptive layer in Example 1, (KF 352A; The Shin-Etsu Chemical Co., Ltd., side chain modification type, HLB=7.0). Thus, a thermal transfer image-receiving sheet of Example 13 was prepared.

Example 14

The procedure of Example 1 was repeated, except that the coating liquid R14 for a receptive layer was used instead of the coating liquid for a receptive layer in Example 1. Thus, a thermal transfer image-receiving sheet of Example 14 was prepared.

Example 15

The procedure of Example 1 was repeated, except that the coating liquid R15 for a receptive layer was used instead of the coating liquid for a receptive layer in Example 1. Thus, a thermal transfer image-receiving sheet of Example 15 was prepared.

Example 16

The procedure of Example 1 was repeated, except that the coating liquid R16 for a receptive layer was used instead of the coating liquid for a receptive layer in Example 1. Thus, a thermal transfer image-receiving sheet of Example 16 was prepared.

Example 17

The procedure of Example 1 was repeated, except that the coating liquid R17 for a receptive layer was used instead of the coating liquid for a receptive layer in Example 1. Thus, a thermal transfer image-receiving sheet of Example 17 was prepared.

Example 18

The procedure of Example 1 was repeated, except that the coating liquid R18 for a receptive layer was used instead of the coating liquid for a receptive layer in Example 1, (FZ 2101; Nippon Unicar Co., Ltd., side chain modification type, HLB=9.0). Thus, a thermal transfer image-receiving sheet of Example 18 was prepared.

Example 19

The procedure of Example 1 was repeated, except that the coating liquid R19 for a receptive layer was used instead of the coating liquid for a receptive layer in Example 1. Thus, a thermal transfer image-receiving sheet of Example 19 was prepared.

Example 20

The procedure of Example 1 was repeated, except that the coating liquid R20 for a receptive layer was used instead of the coating liquid for a receptive layer in Example 1. Thus, a thermal transfer image-receiving sheet of Example 20 was prepared.

Example 21

The procedure of Example 1 was repeated, except that the coating liquid R21 for a receptive layer was used instead of the coating liquid for a receptive layer in Example 1. Thus, a thermal transfer image-receiving sheet of Example 21 was prepared.

Example 22

The procedure of Example 1 was repeated, except that the coating liquid R22 for a receptive layer was used instead of the coating liquid for a receptive layer in Example 1. Thus, a thermal transfer image-receiving sheet of Example 22 was prepared.

Example 23

The procedure of Example 1 was repeated, except that the coating liquid R23 for a receptive layer was used instead of the coating liquid for a receptive layer in Example 1. Thus, a thermal transfer image-receiving sheet of Example 23 was prepared.

Example 24

The procedure of Example 1 was repeated, except that the coating liquid R24 for a receptive layer was used instead of the coating liquid for a receptive layer in Example 1. Thus, a thermal transfer image-receiving sheet of Example 24 was prepared.

Example 25

The procedure of Example 1 was repeated, except that the coating liquid R25 for a receptive layer was used instead of the coating liquid for a receptive layer in Example 1. Thus, a thermal transfer image-receiving sheet of Example 25 was prepared.

Example 26

The procedure of Example 1 was repeated, except that the coating liquid R26 for a receptive layer was used instead of the coating liquid for a receptive layer in Example 1. Thus, a thermal transfer image-receiving sheet of Example 26 was prepared.

[Preparation of Coating Liquids For Receptive Layer]

The following coating liquids for a receptive layer (r1 to r14) were prepared.

Coating liquids for receptive layer:

Coating liquids for a receptive layer were prepared using a vinyl chloride-vinyl acetate copolymer (1000A, manufactured by Denki Kagaku Kogyo K.K.) as a binder resin, a metal ion-containing compound represented by the above chemical formula as a metal source, and a material indicated in Table 2 as an additive according to formulations indicated in Table 2 below.

TABLE 2

List of coating liquid for receptive layer used in comparative examples

| Coating liquid for receptive layer | Binder resin | Metal source | Additive |
|---|---|---|---|
| r1 | 70 | 30 | None |
| r2 | 70 | 30 | FC-431 = 7.50 |
| r3 | 70 | 30 | SC-101 = 2.50 |
| r4 | 70 | 30 | SC-101 = 5.00 |
| r5 | 70 | 30 | X22-3000T = 0.50 |
| r6 | 70 | 30 | X22-3000T = 1.50 |
| r7 | 70 | 30 | X22-3000T = 3.00 |
| r8 | 70 | 30 | X22-3000T = 6.00 |

TABLE 2-continued

List of coating liquid for receptive layer used in comparative examples

| Coating liquid for receptive layer | Binder resin | Metal source | Additive |
|---|---|---|---|
| r9 | 70 | 30 | X22-821 = 5.00 |
| r10 | 70 | 30 | KF945A = 5.00 |
| r11 | 70 | 30 | FZ2222 = 1.50 |
| r12 | 70 | 30 | FZ2222 = 5.00 |
| r13 | 70 | 30 | FZ2203 = 1.50 |
| r14 | 70 | 30 | FZ2203 = 5.00 |

Comparative Example 1

The procedure of Example 1 was repeated, except that the coating liquid r1 for a receptive layer indicated in Table 2 was used instead of the coating liquid for a receptive layer in Example 1. Thus, a thermal transfer image-receiving sheet of Comparative Example 1 was prepared.

Comparative Example 2

The procedure of Example 1 was repeated, except that the coating liquid r2 for a receptive layer (SC-101: perfluoroalkyl-containing oligomer, SEIMI CHEMICAL CO., LTD.) was used instead of the coating liquid for a receptive layer in Example 1. Thus, a thermal transfer image-receiving sheet of Comparative Example 2 was prepared.

Comparative Example 3

The procedure of Example 1 was repeated, except that the coating liquid r3 for a receptive layer was used instead of the coating liquid for a receptive layer in Example 1. Thus, a thermal transfer image-receiving sheet of Comparative Example 3 was prepared.

Comparative Example 4

The procedure of Example 1 was repeated, except that the coating liquid r4 for a receptive layer was used instead of the coating liquid for a receptive layer in Example 1. Thus, a thermal transfer image-receiving sheet of Comparative Example 4 was prepared.

Comparative Example 5

The procedure of Example 1 was repeated, except that the coating liquid r5 for a receptive layer (X22-3000T: epoxy-modified silicone, side chain modification type, The Shin-Etsu Chemical Co., Ltd.) was used instead of the coating liquid for a receptive layer in Example 1. Thus, a thermal transfer image-receiving sheet of Comparative Example 5 was prepared.

Comparative Example 6

The procedure of Example 1 was repeated, except that the coating liquid r6 for a receptive layer was used instead of the coating liquid for a receptive layer in Example 1. Thus, a thermal transfer image-receiving sheet of Comparative Example 6 was prepared.

Comparative Example 7

The procedure of Example 1 was repeated, except that the coating liquid r7 for a receptive layer was used instead of the coating liquid for a receptive layer in Example 1. Thus, a thermal transfer image-receiving sheet of Comparative Example 7 was prepared.

Comparative Example 8

The procedure of Example 1 was repeated, except that the coating liquid r8 for a receptive layer was used instead of the coating liquid for a receptive layer in Example 1. Thus, a thermal transfer image-receiving sheet of Comparative Example 8 was prepared.

Comparative Example 9

The procedure of Example 1 was repeated, except that the coating liquid r9 for a receptive layer (X22-821; The Shin-Etsu Chemical Co., Ltd., fluoro-modified silicone) was used instead of the coating liquid for a receptive layer in Example 1. Thus, a thermal transfer image-receiving sheet of Comparative Example 9 was prepared.

Comparative Example 10

The procedure of Example 1 was repeated, except that the coating liquid r10 for a receptive layer (KF 945: side chain modification type, HLB=4.5, The Shin-Etsu Chemical Co., Ltd.) was used instead of the coating liquid for a receptive layer in Example 1. Thus, a thermal transfer image-receiving sheet of Comparative Example 10 was prepared.

Comparative Example 11

The procedure of Example 1 was repeated, except that the coating liquid r11 for a receptive layer (FZ 2222: main chain modification type, HLB=7.0, Nippon Unicar Co., Ltd.) was used instead of the coating liquid for a receptive layer in Example 1. Thus, a thermal transfer image-receiving sheet of Comparative Example 11 was prepared.

Polyether-modified silicone of main chain modification type:

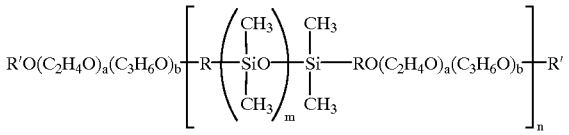

wherein a, b, m, and n are an integer of 1 or more.

Comparative Example 12

The procedure of Example 1 was repeated, except that the coating liquid r12 for a receptive layer was used instead of the coating liquid for a receptive layer in Example 1. Thus, a thermal transfer image-receiving sheet of Comparative Example 12 was prepared.

Comparative Example 13

The procedure of Example 1 was repeated, except that the coating liquid r13 for a receptive layer (FZ 2203: main chain modification type, HLB=1.0, Nippon Unicar Co., Ltd.) was used instead of the coating liquid for a receptive layer in Example 1. Thus, a thermal transfer image-receiving sheet of Comparative Example 13 was prepared.

Comparative Example 14

The procedure of Example 1 was repeated, except that the coating liquid r14 for a receptive layer was used instead of the coating liquid for a receptive layer in Example 1. Thus, a thermal transfer image-receiving sheet of Comparative Example 14 was prepared.

Separately, a 6 μm-thick polyethylene terephthalate film the backside of which had been treated (Lumirror, manufactured by Toray Industries, Inc.) was provided as a substrate. Dye layers of YMC were provided in a face serial manner on the substrate in its side remote from the treated side as the backside. Thus, a thermal transfer sheet was prepared. In forming the dye layers, the following coating liquids containing thermally diffusive dyes (Y-1, M-1, C-1), which can be chelated, were coated to a thickness of 1.2 μm on a dry basis for each dye layer.

(Coating liquid for yellow dye layer)

| | |
|---|---|
| Chelate dye (compound Y-1 below) | 4 parts |
| Polyvinyl butyral resin | 70 parts |
| Methyl ethyl ketone | 13 parts |
| Toluene | 13 parts |

Y-1

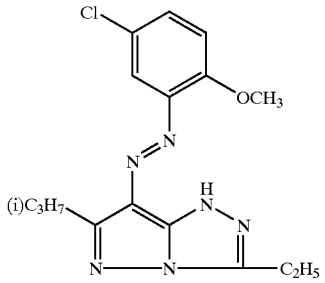

(Coating liquid for magenta dye layer)

| | |
|---|---|
| Chelate dye (compound M-1 below) | 4 parts |
| Polyvinyl butyral resin | 70 parts |
| Methyl ethyl ketone | 13 parts |
| Toluene | 13 parts |

M-1

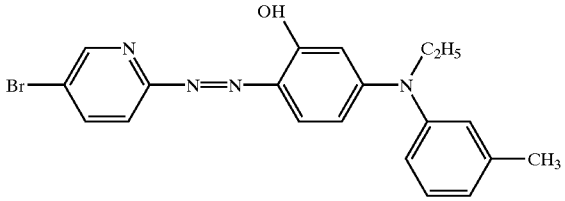

(Coating liquid for cyan dye layer)

| | |
|---|---|
| Chelate dye (compound C-1 below) | 4 parts |
| Polyvinyl butyral resin | 70 parts |
| Methyl ethyl ketone | 13 parts |
| Toluene | 13 parts |

C-1

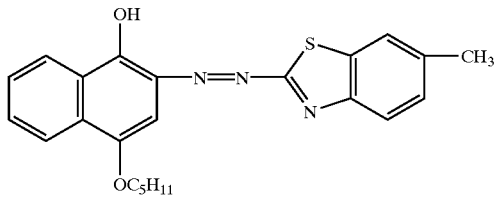

Further, a protective layer transfer sheet was prepared under the following conditions. A 6 μm-thick polyethylene terephthalate film the backside of which had been treated (Lumirror, manufactured by Toray Industries, Inc.) was provided as a substrate. A coating liquid having the following composition for a release layer was coated on the substrate in its side remote from the treated side as the backside to a thickness of 0.5 μm on a dry basis to form a release layer. A coating liquid having the following composition for a protective layer was coated on the release layer to a thickness of 2 μm on a dry basis to form a protective layer. Thus, a protective layer transfer sheet was provided.

| | |
|---|---|
| (Coating liquid for release layer) | |
| Ionomer resin (manufactured by Mitsui Chemicals Inc.) | 10 parts |
| Water/ethanol (mass ratio = 2/3) | 100 parts |
| (Coating liquid for protective layer) | |
| Vinyl chloride-vinyl acetate copolymer (Denka Vinyl 1000ALK, manufactured by Denki Kagaku Kogyo K.K.) | 15 parts |
| Copolymer resin to which reactive ultraviolet absorber has been reactively bonded (UVA 635 L, manufactured by BASF Japan Ltd.) | 20 parts |
| Methyl ethyl ketone/toluene (mass ratio = 1/1) | 100 parts |

Thermal transfer image-receiving sheets prepared in the above examples and comparative examples were provided. The protective layer transfer sheet prepared above was put on top of the thermal transfer image-receiving sheet so that the protective layer in the protective layer transfer sheet faced the receptive layer in the thermal transfer image-receiving sheet, followed by the transfer of the protective layer onto the whole area of the receptive layer by means of a thermal head under the following printing conditions. In this case, the thermal transfer image-receiving sheet was used in such a state that any image was not formed on the receptive layer.

(Printing Conditions)

Thermal head: KGT-217-12 MPL20, manufactured by Kyocera Corp.

Average resistance value of heating element: 3195 Ω

Print density in scanning direction: 300 dpi

Print density in feed direction: 300 dpi

Applied power: 0.12 w/dot one line period: 5 msec

Printing initiation temp.: 40° C.

Applied pulse: A multipulse-type test printer was used wherein the number of divided pulses with a pulse length obtained by equally dividing one line period into 256 parts is variable from 0 to 255 during one line period. In this case, the duty ratio for each divided pulse was fixed to 60%, and the number of pulses per line period was fixed to 210. Thus, solid printing was performed to transfer a protective layer on the whole area of the receptive layer.

For the thermal transfer image-receiving sheets onto which the protective layer had been transferred, the adhesion of the protective layer was evaluated under the following conditions.

(Adhesion of Protective Layer) (Initial Adhesion)

Immediately after the preparation of the thermal transfer image-receiving sheet, the transfer of the protective layer was carried out on the transfer image-receiving sheet. A mending tape manufactured by Sumitomo 3M Ltd. was put on the surface of the thermal transfer image-receiving sheet onto which the protective layer had been transferred. The mending tape was then rubbed back and forth once with a finger to adhere the mending tape to the protective layer. Immediately after that, the mending tape was pulled with a finger at a peel angle of 180 degrees to separate the tape. In this case, visual inspection was performed for whether or not the protective layer was transferred on the tape side.

(Adhesion of Protective Layer) (After Storage At 60° C. For 3 Days)

After the preparation, the thermal transfer image-receiving sheet was allowed to stand under an environment of 60° C. for 3 days, and the temperature of the thermal transfer image-receiving sheet was then returned to room temperature. Thereafter, the protective layer was transferred onto the thermal transfer image-receiving sheet. A mending tape manufactured by Sumitomo 3M Ltd. was then put on the surface of the thermal transfer image-receiving sheet onto which the protective layer had been transferred. The mending tape was then rubbed back and forth once with a finger to adhere the mending tape to the protective layer. Immediately after that, the mending tape was pulled with a finger at a peel angle of 180 degrees to separate the tape. In this case, visual inspection was performed for whether or not the protective layer was transferred on the tape side.

The adhesion of the protective layer was evaluated according to the following criteria.

○: The protective layer remained untransferred on the tape side (the protective layer was not separated from the thermal transfer image-receiving sheet).

Δ: A part of the protective layer was transferred on the tape side (a part of the protective layer was separated from the print).

X: The major part of the protective layer was transferred on the tape side (the major part of the protective layer was separated from the print).

The thermal transfer image-receiving sheets prepared in the above examples and comparative examples and the thermal transfer sheet prepared above were provided. The thermal transfer sheet was put on top of the thermal transfer image-receiving sheet so that the dye layer faced the receptive layer. Thermal transfer recording was carried out in the order of Y, M, and C from the backside of the thermal transfer sheet by means of a thermal head under the following conditions to form a gray solid image, followed by the measurement of the force of peeling between the receptive layer and the dye layer and evaluation of abnormal transfer under the following conditions.

(Printing Conditions)

Thermal head: KGT-217-12 MPL20, manufactured by Kyocera Corp.

Average resistance value of heating element: 3195 Ω

Print density in scanning direction: 300 dpi

Print density in feed direction: 300 dpi

Applied power: 0.12 w/dot

One line period: 5 msec

Printing initiation temp.: 40° C.

Applied pulse: A multipulse-type test printer was used wherein the number of divided pulses with a pulse length obtained by equally dividing one line period into 256 parts is variable from 0 to 255 during one line period. In this case, the duty ratio for each divided pulse was fixed to 60%, and the number of pulses per line period was fixed to 255. After the printing of Ye, Mg was printed in the same place, followed by printing of Cy to transfer a dye layer on the whole area of the printing face. Thus, a black solid image was formed.

(Abnormal Transfer)

The thermal transfer image-receiving sheets prepared in the above examples and comparative examples and the thermal transfer sheet prepared above were provided. The thermal transfer sheet was put on top of the thermal transfer image-receiving sheet so that the dye layer faced the receive layer. Thermal transfer recording was carried out in the order of Y, M, and C on the surface of the receptive layer by means of a thermal head under the above printing conditions to form a black solid image. In this case, visual inspection was performed for whether or not, in the transfer of a dye from the dye layer in the thermal transfer sheet to the receptive layer, abnormal transfer took place at the time of the separation of Cy (i.e., to examine separation between the dye layer and the receptive layer at the time of the image formation).

The criteria of the evaluation were as follows.

○: The dye was normally transferred from the dye layer onto the receptive layer, and no abnormal transfer took place.

X: At the time of the transfer of Cy as the third color, the dye was not normally transferred from the dye layer onto the receptive layer, and abnormal transfer of the dye, together with the binder, took place, or otherwise, the film was adhered onto receptive layer.

XX: At the time of the transfer of Ye as the first color, the dye was not normally transferred, and abnormal transfer of the dye, together with the binder, took place, or otherwise, the film was adhered onto receptive layer.

For the thermal transfer image-receiving sheets prepared in Examples 1 to 26 and Comparative Examples 1 to 14, the results of evaluation were as shown in Tables 3 and 4 below.

TABLE 3

Evaluation results of examples

| | Receptive layer | Adhesion of protective layer (initial) | Adhesion of protective layer (after 3 days at 60° C.) | Abnormal transfer |
|---|---|---|---|---|
| Ex. 1 | R1 | ○ | ○ | X |
| Ex. 2 | R2 | ○ | ○ | X |
| Ex. 3 | R3 | ○ | ○ | ○ |
| Ex. 4 | R4 | ○ | ○ | ○ |
| Ex. 5 | R5 | ○ | ○ | ○ |
| Ex. 6 | R6 | ○ | ○ | ○ |
| Ex. 7 | R7 | ○ | ○ | ○ |
| Ex. 8 | R8 | ○ | ○ | X |
| Ex. 9 | R9 | ○ | ○ | X |
| Ex. 10 | R10 | ○ | ○ | ○ |
| Ex. 11 | R11 | ○ | ○ | ○ |
| Ex. 12 | R12 | ○ | ○ | ○ |
| Ex. 13 | R13 | ○ | ○ | ○ |
| Ex. 14 | R14 | ○ | ○ | ○ |
| Ex. 15 | R15 | ○ | ○ | ○ |
| Ex. 16 | R16 | ○ | ○ | ○ |
| Ex. 17 | R17 | ○ | ○ | ○ |
| Ex. 18 | R18 | ○ | ○ | ○ |
| Ex. 19 | R19 | ○ | ○ | ○ |
| Ex. 20 | R20 | ○ | ○ | ○ |
| Ex. 21 | R21 | ○ | ○ | ○ |
| Ex. 22 | R22 | ○ | ○ | ○ |
| Ex. 23 | R23 | ○ | ○ | ○ |
| Ex. 24 | R24 | ○ | ○ | ○ |
| Ex. 25 | R25 | ○ | ○ | ○ |
| Ex. 26 | R26 | ○ | ○ | ○ |

As is apparent from the foregoing description, in the thermal transfer image-receiving sheet comprising a receptive layer provided on a substrate sheet, the incorporation of a metal source, a protective layer bonding/holding agent, and a binder resin into the receptive layer enables a deterioration in adhesion between the transferred protective layer and the receptive layer caused by the metal source to be prevented by the protective layer bonding/holding agent. This can realize a thermal transfer image-receiving sheet which can provide images possessing excellent quality by virtue of a chelated dye.

The addition of the protective layer bonding/holding agent in an amount of 0.25 to 7.5% by mass based on the solid content of the whole receptive layer can provide good adhesion between the receptive layer and the protective layer and thus is preferred.

Further, the additional incorporation of a release agent into the receptive layer is preferred because no abnormal transfer takes place at the time of image formation using a thermal transfer sheet.

What is claimed is:

1. A thermal transfer image-receiving sheet comprising: a substrate sheet; and a receptive layer provided on the substrate sheet, said receptive layer comprising a metal source that is capable of chelating a dye transferred from a sublimable dye layer of a thermal transfer sheet and thereby fixing the dye onto the receptive layer, a protective layer bonding/holding agent comprising a surfactant having a polyoxyalkylene group in its structure, and a binder resin.

2. The thermal transfer image-receiving sheet according to claim 1, wherein the protective layer bonding/holding agent comprises a fluorosurfactant having a polyoxyalkylene group in its structure.

3. The thermal transfer image-receiving sheet according to claim 1, wherein the protective layer bonding/holding agent comprises a polyether-modified silicone having a polyoxyalkylene group in its structure.

4. The thermal transfer image-receiving sheet according to claim 1, wherein the receptive layer further comprises a release agent.

5. The thermal transfer image-receiving sheet according to claim 1, wherein the metal source is a complex compound of a transition metal ion, the complex compound capable of chelating a dye having a group that can combine with the metal source to form a complex.

6. The thermal transfer image-receiving sheet according to claim 1, wherein the receptive layer contains the protective layer bonding/holding agent in an amount of 0.25 to 7.5% by mass based on the solid content of the whole receptive layer.

7. The thermal transfer image-receiving sheet according to claim 1, wherein the protective layer bonding/holding agent comprises a component having an HLB value of not less than 5.0.

8. A thermal transfer image-receiving sheet comprising:

a substrate sheet; and a receptive layer provided on the substrate sheet, said receptive layer comprising a metal source, a protective layer bonding/holding agent comprising a fluorsurfactant having a polyoxyalkylene group in its structure, and a binder resin.

9. A thermal transfer image-receiving sheet comprising:

a substrate sheet; and a receptive layer provided on the substrate sheet, said receptive layer comprising a metal source, a protective layer bonding/holding agent comprising a polyether-modified silicone having a polyoxyalkylene group in its structure, and a binder resin.

10. The thermal transfer image-receiving sheet according to claim 1, wherein the metal source is a compound of the formula $M^{2+}(X)_n2Y$ wherein $M^{2+}$ is a divalent transition metal ion;

X is a coordination compound that can be coordinately bonded to $M^{2+}$ to form a complex;

n is an integer of 2 or 3; and $Y^-$ is a counter ion of $M^{2+}$, with the proviso that a plurality of Xs may be the same or different.

* * * * *

UNITED STATES PATENT AND TRADEMARK OFFICE

CERTIFICATE OF CORRECTION

PATENT NO. : 6,620,765 B2
DATED : September 16, 2003
INVENTOR(S) : Tomoyuki Idehara et al.

It is certified that error appears in the above-identified patent and that said Letters Patent is hereby corrected as shown below:

Title page,
Item [73], Assignee, change "Inc." to -- Ltd. --.

Signed and Sealed this

Eighteenth Day of November, 2003

JAMES E. ROGAN
*Director of the United States Patent and Trademark Office*